US009839311B2

(12) United States Patent
Shames

(10) Patent No.: US 9,839,311 B2
(45) Date of Patent: Dec. 12, 2017

(54) MULTIPURPOSE SERVING TRAY

(71) Applicant: Lisa Shames, Thousand Oaks, CA (US)

(72) Inventor: Lisa Shames, Thousand Oaks, CA (US)

( * ) Notice: Subject to any disclaimer, the term of this patent is extended or adjusted under 35 U.S.C. 154(b) by 0 days.

(21) Appl. No.: 14/585,674

(22) Filed: Dec. 30, 2014

(65) Prior Publication Data

US 2015/0182054 A1 Jul. 2, 2015

Related U.S. Application Data

(60) Provisional application No. 61/921,659, filed on Dec. 30, 2013.

(51) Int. Cl.

| | |
|---|---|
| ***A47G 19/06*** | (2006.01) |
| ***A47G 23/06*** | (2006.01) |
| ***A47G 19/02*** | (2006.01) |
| ***A47G 23/08*** | (2006.01) |

(52) U.S. Cl.

CPC ..... *A47G 23/0641* (2013.01); *A47G 19/065* (2013.01); *A47G 23/0625* (2013.01); *A47G 23/08* (2013.01)

(58) Field of Classification Search

CPC .. A47G 19/06; A47G 19/065; A47G 23/0641; A47G 23/0625; A47G 23/08

USPC ..... 220/574, 575; 206/265, 563, 564, 557

See application file for complete search history.

(56) References Cited

U.S. PATENT DOCUMENTS

| | | | | |
|---|---|---|---|---|
| D87,682 | S | 8/1932 | Porter | |
| D105,687 | S | 8/1937 | Bode | D7/702 |
| 3,491,893 | A | 1/1970 | Morris | |
| 4,334,623 | A | 6/1982 | Geary | |
| 4,516,685 | A | 5/1985 | French | 206/563 |
| D326,588 | S | 6/1992 | Meisel | D7/549 |
| 5,234,125 | A * | 8/1993 | Roberts | A47G 19/065 206/562 |
| D342,421 | S | 12/1993 | DuBow | D7/708 |
| 5,419,455 | A * | 5/1995 | Russeau | 220/575 |
| D359,885 | S | 7/1995 | Yanuzzi | D7/549 |
| 5,711,595 | A | 1/1998 | Gerbe | |
| 5,769,264 | A | 6/1998 | Lipkowitz | |
| 5,772,050 | A | 6/1998 | Shih | |
| 6,021,914 | A * | 2/2000 | Schmidt | 220/574 |
| D453,891 | S | 2/2002 | Sussman | D7/553.1 |
| 6,964,443 | B1 | 11/2005 | Newton | |
| 7,334,908 | B1 | 2/2008 | Figueroa | |
| D563,726 | S | 3/2008 | Fraser | |
| D575,600 | S | 8/2008 | Mayer | D7/553.1 |
| D576,455 | S | 9/2008 | Siddle | D7/701 |
| 7,562,785 | B2 | 7/2009 | Meissen | |

(Continued)

FOREIGN PATENT DOCUMENTS

| | | |
|---|---|---|
| CA | 2136485 | 5/1996 |

*Primary Examiner* — King M Chu

(74) *Attorney, Agent, or Firm* — Koppel, Patrick, Heybl & Philpott

(57) ABSTRACT

Serving trays configured to securely hold both stemware and/or non-stemware articles, such as glasses, are disclosed herein. The trays can comprise securing portions, which in turn can comprise channel and receptacle portions allowing for easy and secure holding of stemware by the tray. The tray can further comprise features for securing non-stemware articles and in some embodiments, can comprise features for securing both stemware and non-stemware articles. The trays can further comprise various features to improve the stability and handling of the tray.

8 Claims, 5 Drawing Sheets

(56) References Cited

U.S. PATENT DOCUMENTS

| | | | | |
|---|---|---|---|---|
| D614,926 | S | 5/2010 | Cox | D7/708 |
| D623,478 | S | 9/2010 | Hayashi | D7/551.1 |
| D651,028 | S | 12/2011 | Grimaldi | |
| 8,186,524 | B2 | 5/2012 | Siahpush | |
| 8,272,512 | B2 | 9/2012 | Joseph | |
| 8,746,456 | B1 * | 6/2014 | Bradley | 206/562 |
| D708,062 | S | 7/2014 | Navarro et al. | D7/702 |
| 2005/0017134 | A1 * | 1/2005 | Hooper | 248/103 |
| 2008/0264822 | A1 * | 10/2008 | Faiola | A47G 19/06 206/561 |
| 2010/0230419 | A1 * | 9/2010 | Joseph | 220/574 |
| 2012/0031806 | A1 | 2/2012 | Riley | |
| 2012/0097574 | A1 | 4/2012 | Parsons | |

* cited by examiner

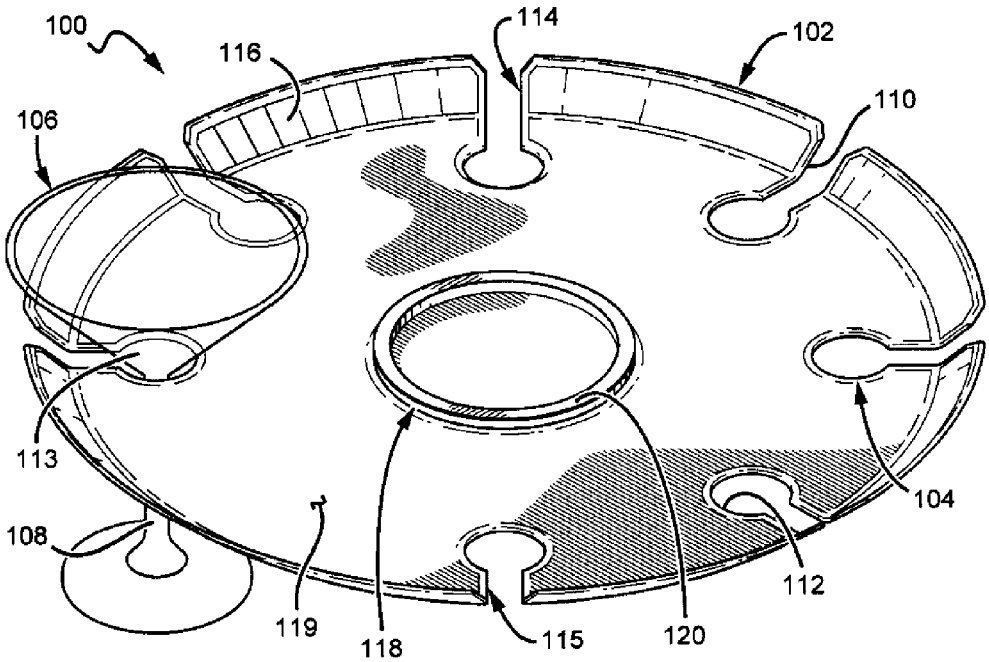
FIG. 1
FIG. 8
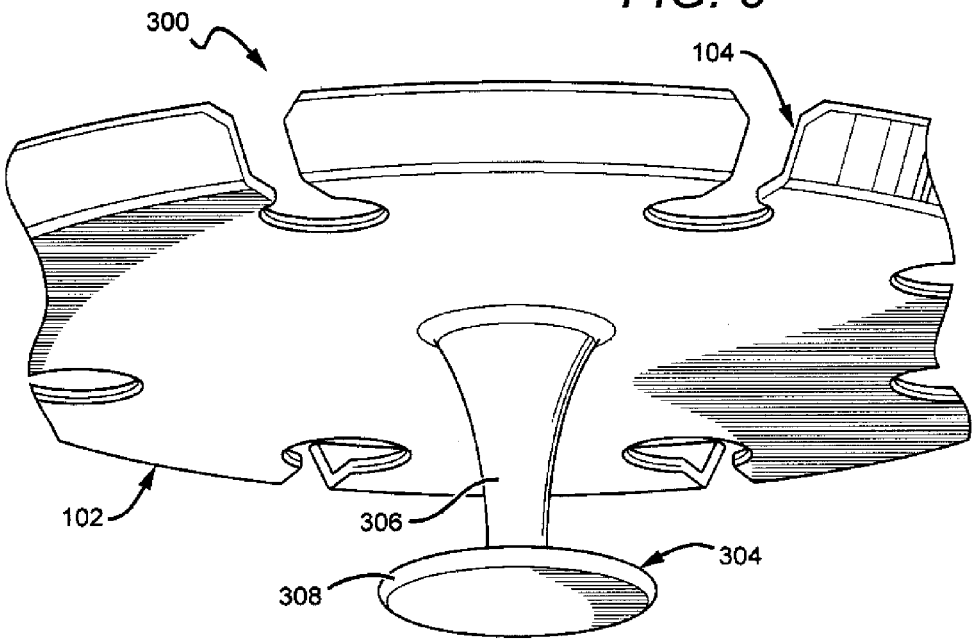

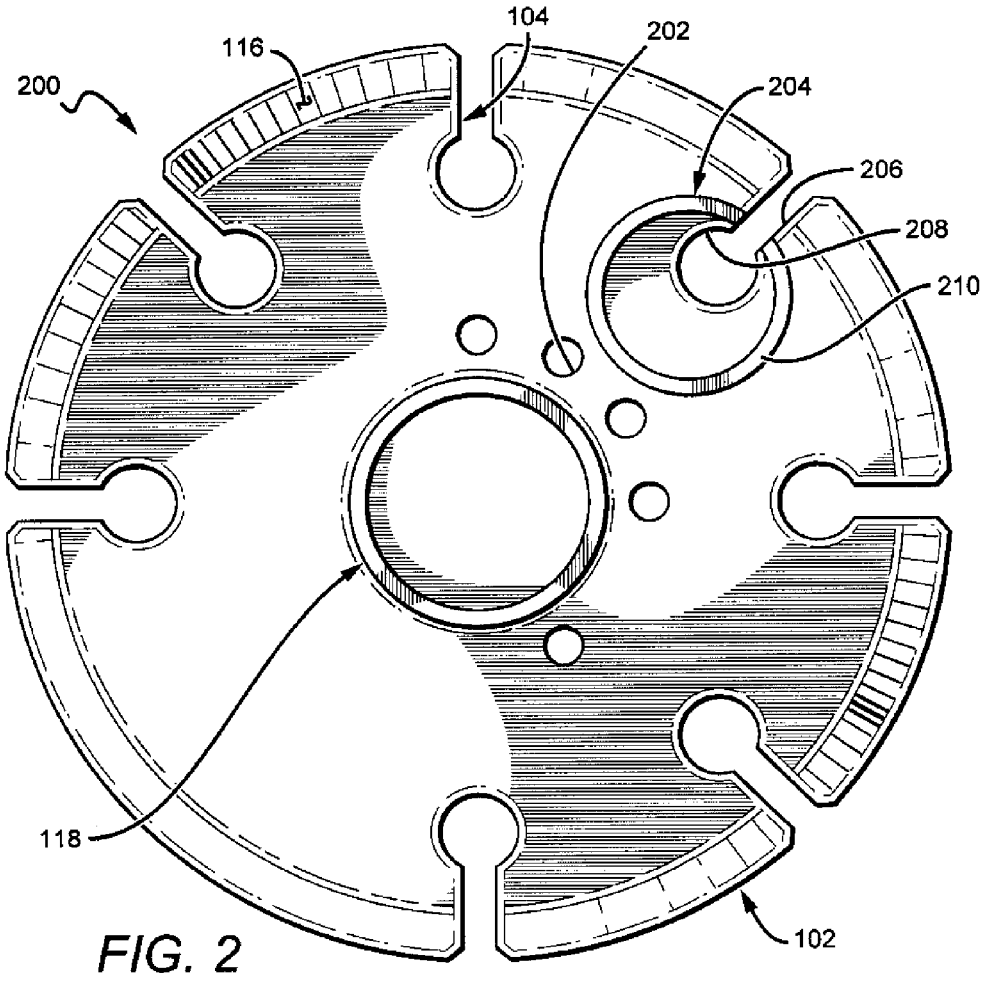
FIG. 2
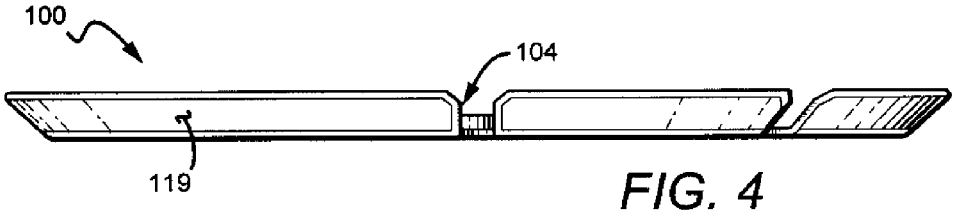
FIG. 4
FIG. 5
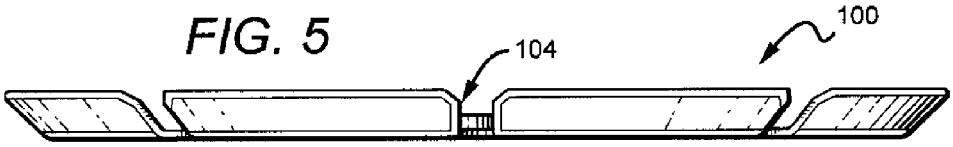

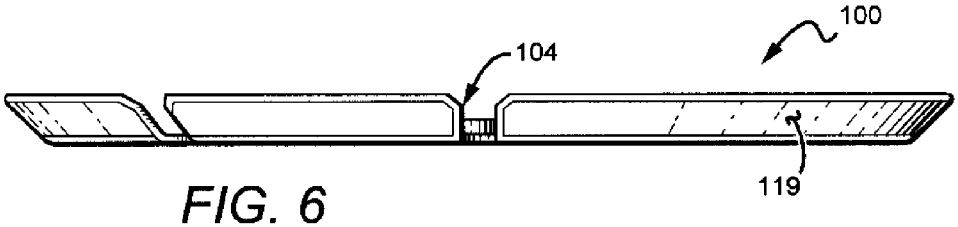
FIG. 6
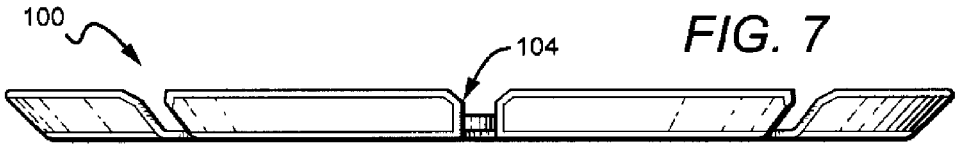
FIG. 7
FIG. 3
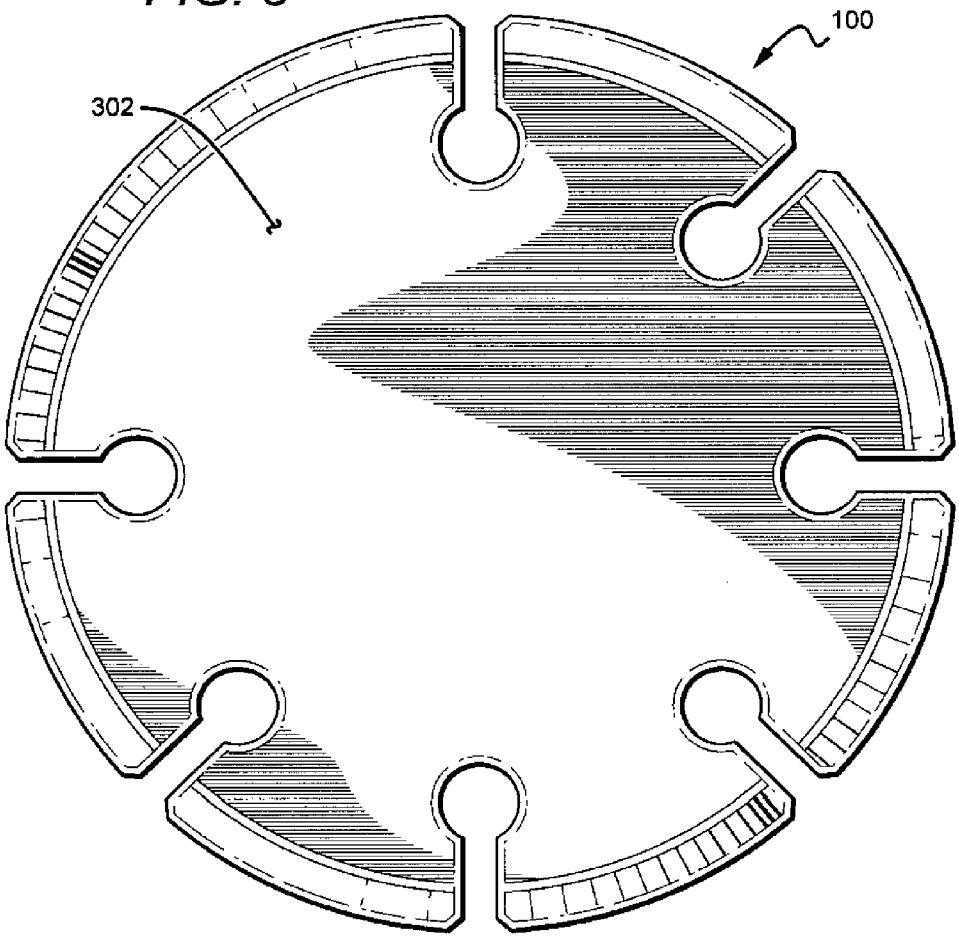

MULTIPURPOSE SERVING TRAY

CROSS REFERENCE TO RELATED APPLICATIONS

This application claims the benefit of U.S. Provisional Patent Application Ser. No. 61/921,659, filed on 30 Dec. 2013, to Lisa Shames, entitled MULTIPURPOSE SERVING TRAY, which is hereby incorporated herein in its entirety by reference.

BACKGROUND OF THE INVENTION

Field of the Invention

The present invention relates generally to serving trays for use by individuals and/or members of the food services industry, and specifically for serving trays for transporting stemware articles.

Description of the Related Art

At various commercial or business-related, as well as at restaurants and individually hosted parties and gatherings, refreshments, such as food and drink, are often served to attendees. During these very social functions, attendees are often in different areas and refreshments must be brought out to them.

The typical utensil utilized in transporting refreshments to the above mentioned attendees is the basic tray, a flat, typically circular surface that an individual supports from the bottom and upon which the individual places multiple refreshments to be delivered to the attendees.

There are several disadvantages to using the above mentioned basic tray in the transport of refreshments to and from guests. For example, certain refreshments, notably, drinks, are particularly susceptible to changes in motion of the underlying tray, which can result in unwanted spillage, breakage of glass, and possible injury to server and/or attendee. The glasses containing the drinks can easily move and slide along the top of the tray and, especially in the case of stemware glasses (such as wine, martini, and champagne glasses), can topple over completely. Furthermore, it is difficult for servers utilizing these basic trays to properly balance various refreshments on the tray's surface and thus stabilize the tray; this is especially true as servers are loading objects on and removing objects from the tray and thus affecting the weight distribution of objects on the tray.

Thus, an improved serving tray comprising various features to improve the stability and safety of refreshments during transportation is needed.

SUMMARY OF THE INVENTION

Described herein are serving trays comprising features that allow for enhanced transport of articles, such as drinking glasses or other consumption related items. These serving trays allow for a user to safely and securely transport multiple drinks or items. These trays can comprise features for the securing of stemware and non-stemware articles to the tray. In some embodiments, the trays further comprise additional features for structural support and improved handling.

In one embodiment, a tray comprises a body and at least one securing portion configured to receive at least one stemware article and one or more features configured to receive at least one non-stemware article.

In another embodiment, a tray comprises a body, at least one securing portion within the body comprising a channel leading from an edge of the body to a receptacle area, and a raised border at least partially surrounding the securing portion.

In yet embodiment, a tray comprises a body, and a plurality of securing portions within the body, with each securing portion in the plurality configured to receive at least one stemware article.

These and other further features and advantages of the invention would be apparent to those skilled in the art from the following detailed description, taking together with the accompanying drawings, in which:

BRIEF DESCRIPTION OF THE DRAWINGS

FIG. 1 is a top, front, perspective view of a serving tray according to an embodiment incorporating features of the present invention;

FIG. 2 is a top plan view of a serving tray according to an embodiment incorporating features of the present invention;

FIG. 3 is a bottom plan view of the serving tray shown in FIG. 1;

FIG. 4 is a front elevation view of the serving tray shown in FIG. 1;

FIG. 5 is a rear elevation view of the serving tray shown in FIG. 1;

FIG. 6 is a left side elevation view of the serving tray shown in FIG. 1;

FIG. 7 is a right side elevation view of the serving tray shown in FIG. 1;

FIG. 8 is a bottom perspective view of a serving tray according to an embodiment incorporating features of the present invention;

Figure 9:
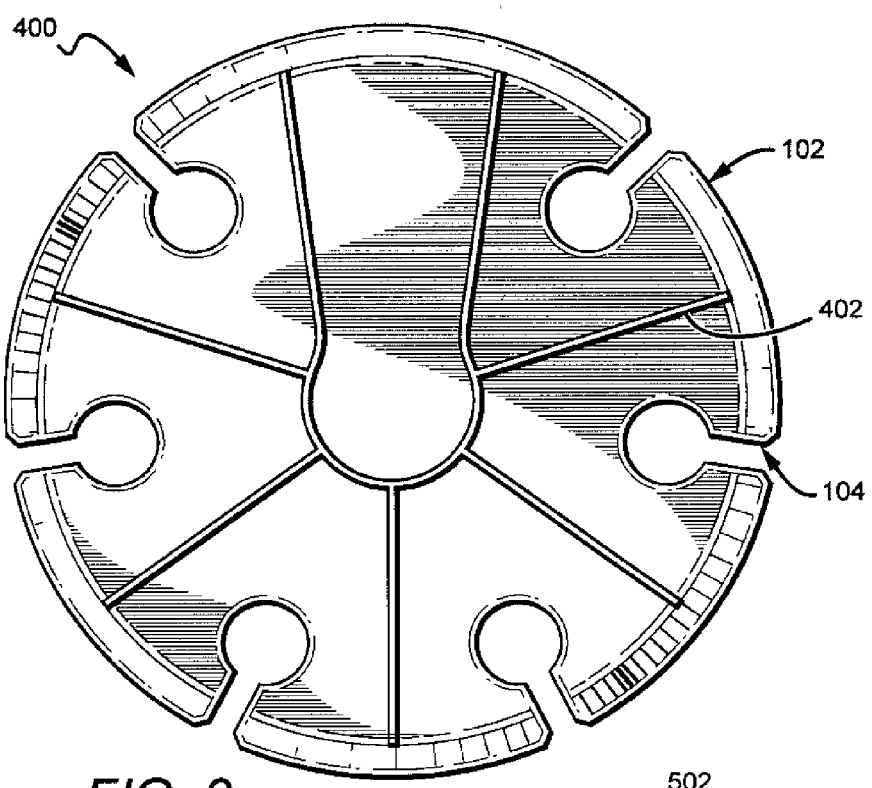
FIG. 9 is a bottom plan view of a serving tray according to an embodiment incorporating features of the present invention.

The broken lines in FIG. 1 depict environmental subject matter only (in particular a stemware glass) and form no part of the claimed invention.

DETAILED DESCRIPTION OF THE INVENTION

Serving trays incorporating features of the present invention can comprise various combinations of features for improving the securing and transport of both stemware and non-stemware articles, such as various cups, containers, glasses (including non-glassware glasses), dishes, plates and bowls. In some embodiments, serving trays comprise a body and one or more securing portions. The securing portions can comprise a channel within the serving tray body which terminates in a receptacle portion.

A user can place the stemware-shaft portion of an article of stemware, or an object shaped similar to stemware, for example, a martini glass, through the channel and allow the glass to come to rest in the receptacle portion. When a server lifts and carries the tray to transport the stemware, the securing portion holds the stemware securely in place, with the receiving base portion of the stemware (where the container portion of the stemware meets the stemware shaft) resting in the receptacle. The user can remove the glasses manually, for example, by placing the tray back down on a surface, this allows the user to then once again easily remove the articles of stemware. Alternatively, the user can remove and add glasses to the tray while the tray is being carried or is otherwise suspended in mid-air.

Serving trays incorporating features of the present invention can also include features for holding non-stemware articles, for example, raised border portions with dimensions corresponding to the dimensions of a standard size non-stemware glass, for example, a common whisky glass. In some embodiments, a securing portion can be combined with a raised border structure and thus function to securely hold both stemware and non-stemware articles with a single securing portion.

Serving trays incorporating features of the present invention can further comprise other useful features for improving the ability of a user to more securely transport various articles, for example, finger holes, handgrip portions, raised lips and/or support structures could all be used to provide additional stability.

Trays incorporating features of the present invention can additionally comprise features allowing alterability of the shape of the tray, for example, a hinge-structure or flexible line through the center of the tray. This allows for the tray to be folded up into a different shape when not in use and easily stored. It is understood that any features allowing the bending, folding or otherwise altering of shape of the tray, which are known in the art, is within the perimeters of the present disclosure.

Throughout this description, the preferred embodiment and examples illustrated should be considered as exemplars, rather than as limitations on the present invention. As used herein, the term "invention," "device," "method," "present invention," "present device" or "present method" refers to any one of the embodiments of the invention described herein, and any equivalents. Furthermore, reference to various feature(s) of the "invention," "device," "method," "present invention," "present device" or "present method" throughout this document does not mean that all claimed embodiments or methods must include the referenced feature(s).

It is also understood that when an element or feature is referred to as being "on" or "adjacent" to another element or feature, it can be directly on or adjacent the other element or feature or intervening elements or features may also be present. It is also understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "outer", "above", "lower", "below", "horizontal," "vertical" and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention. As used herein, the term "and/or" includes any and all combinations of one or more of the associated list items.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein but are to include deviations in shapes that result, for example, from manufacturing.

FIG. 1 shows a serving tray 100 comprising a body 102 and one or more securing portions 104 (seven shown). It is understood that various numbers of securing portions can be utilized with serving trays incorporating features of the present invention. In some embodiments there are six securing portions 104, in other embodiments there are seven or more or five or less. The securing portions 104 can be configured to securely hold stemware, such as the example martini glass 106 shown in phantom, in place. Each serving portion 104 includes a channel 110 and a receptacle 112. To secure an article of stemware to the serving tray 100, a user would slide the stem-shaft portion 108 of an article of stemware through the channel 110 of a securing portion 104, until the stemware article has passed through the channel and into the receptacle 112 of the securing portion 104.

By lifting the serving tray, the receiving base portion 113 of an article of stemware is brought to rest on or in the receptacle 112 of the securing portion 104. The receptacle 112 helps to hold an article of stemware in place and to prevent or restrict motion of the stemware article, thus preventing or mitigating spillage of the contents of the stemware article and/or damage to the stemware article caused by unrestricted motion. With this arrangement, an article of stemware can be easily placed on and removed from the serving tray 100 through the use of an intentional force by, for example, manually manipulating the glass. However, the glass will not be substantially disturbed by unintentional forces such as the traveling motion of a server carrying the tray.

The body 102 of the serving tray 100 can be made from any suitable material that could support the weight of the intended articles to be transported. Some example materials include but are not limited to resin, rubber, vinyl, polyurethane, poly vinyl chloride (PVC), polystyrene foam, polymers/copolymer substances, acrylic substances, plastic, leather, metal, glass, fiberglass, wood, cloth or a combination thereof. The body 102 can be formed by any suitable method known in the art, for example, molding, injection molding, stamping and extrusion. While the body 102 is shown in the figures to be generally round, it is understood that the body can comprise any number of different shapes and sizes including, for example, any regular polygon or a shape imitating a caricature or real-world object, for example, a star-shaped sheriff's badge for a police officer's retirement party, a sport's mascot for an anticipated game party, a symbol or shape to help promote marketing, or a clown's face for a child's birthday party.

The channels 110 and the receptacles 112 of the securing portions 104 can comprise various shapes and dimensions to accommodate various types of articles. The shaft may be straight or curved and the receptacles may be of any shape or size. In some embodiments the dimensions of securing portions 104 are configured to accept standard stemware glasses such as wine, champagne and/or martini glasses. In some embodiments, the securing portions 104 are configured to hold dessert serving glasses such as those commonly used to serve ice cream, gelato or sorbet for example, where the shaft of the tray may be widened to accommodate wider stemmed dessert stemware. It is understood that the term stemware as used herein includes not only traditional stemware drinking glasses, but any article that can contain a substance, such as a refreshment, drink, and/or food, that comprises an elongated stem-shaft portion. Further example shapes and configurations of channels 110 and receptacles 112 are set forth in FIG. 10 below.

Multiple instances of the securing portions 104 can be aligned or arranged to counterbalance the weight of articles applied to a corresponding securing portion 104. For example, securing portions can be arranged across from one another such that a server can place one article in a first securing portion 114 and place a second in a corresponding securing portion 115, so that the weight of the articles is more evenly distributed, assisting in the transport of refreshments.

In order to provide additional features for the securing of articles to the serving tray 100, serving trays incorporating features of the present invention can further comprise a raised lip 116 around the perimeter of the serving tray 100. The raised lip 116 can further provide support and stabilization for connected stemware, for example, as shown in FIG. 1 with regard to the example stemware martini glass 106. The raised lip 116 can abut against an article of connected stemware and hinder motion of the article should the article begin to approach the sides of the serving tray 100. A user, however, could easily remove an article of stemware from the tray or place one thereon by intentionally lifting the article to align an article's stem-shaft portion with the channel 110.

Serving trays incorporating features of the present invention can further comprise one or more holding portions 118 (one shown in FIG. 2) which can be configured to hold non-stemware articles, for example, non-stemware drinking glasses, dishes, trays, eating utensils, bowls and/or food, such as cheese for a "wine and cheese" social event. These holding portions can be configured to directly hold such non-stemware articles or hold these articles through a series of connecting intermediate structures, such as via a freely removable cup-portion for holding food items that connects to the holding portion 118. The holding portion 118 can comprise a raised border 120 that is configured to accommodate the dimensions of an article, for example, by securely fitting around the base of a non-stemware glass. In addition to or in lieu of the raised border, the holding portion 118 can comprise a recessed portion with dimensions fitting an article. In some embodiments the holding portion 118 comprises an adhesive or frictional surface, for example, a roughed and/or etched patterned or embossed surface or a cork surface, to prevent or hinder drink movement. Additionally, the front surface of the tray (and/or the underside) may have an anti-skid skin that is either permanently adhered or entirely removable (and possibly interchangeable) to further increase friction and reduce either sliding of an article being delivered or as is the case of added anti-skid skin on the underside, may serve to stabilize a servers hand from unwanted movement. These anti-skid skins may be of cork, rubber, vinyl or any number of materials as described in the earlier portion of this document. These anti-skid skins may be of solid color, patterned design, and may include photographs, logos, print, or other indicia as described in this document as a means for enhancing aesthetics and/or providing an opportunity for promotional marketing or advertising of a business, event, or for personal enhancement and customization (e.g., photographs, personalized art, etc.).

One or more optional dedicated free portions 119 (one shown) of the serving tray 100 can comprise a substantially empty space with no instances of the securing portions 104 and/or holding portions 118. This allows for a convenient area where a user can place his or her arm without disturbing articles of stemware or having to balance additional weight upon the user's arm. This free portion 119 and/or a portion of the perimeter of the tray, for example, the raised lip portion, can also be configured to comprise a grip or handle portion to facilitate use of the tray.

Referring now to FIG. 2, which shows a top plan view of a serving tray 200, similar to the serving tray 100 in FIG. 1 above, wherein like reference numbers are used to denote like features. The serving tray 200 comprises a body 102, one or more securing portions 104, a raised lip 116 and a holding portion 118. However, the serving tray 200 in FIG. 2 further comprises additional features to improve upon basic serving trays.

The serving tray 200 can comprise one or more finger holes 202, to provide an additional means for effectively carrying the serving tray 200. The finger holes 202 allow a user to more effectively hold and grip the serving tray 200 with one hand by resting the bottom of the serving tray 200 on the palm of one's hand and inserting one's fingers through the finger holes. The inner perimeter of the finger holes 202 can be treated so that it is more comfortable for a user's fingers, for example, by etching, machining, chemically treating and/or coating the perimeters with a softer material (for example leather, cloth or rubber).

Another feature a serving tray according to the present disclosure can include is one or more "combination securing portions" 204, which are configured to accept a stemware article in a manner similar to the securing portions 104 in FIG. 1 above, but are also configured to accept a non-stemware article in a manner similar to the holding portions 118 in FIG. 1 above. The combination securing portions 204 can comprise a channel 206, a receptacle 208 and a raised border (or recessed area as mentioned above) 210 surrounding the receptacle. The channel 204 and the receptacle 208 function similarly to the channel 110 and the receptacle 112 in FIG. 1 above and the raised border 210 functions similarly to the raised border 120 of FIG. 1 above. Like in FIG. 1 above, a recessed portion and/or an adhesive or frictional surface can be used in lieu of or in addition to the raised border 210. In the embodiment shown, the raised border 210 completely surrounds receptacle area 208 and nearly completely surrounds the channel 206, except for a portion of the channel 206 near the edge of the body 102 where the user can insert the stemware-shaft portion of an article of stemware.

The combination securing portion 204 can thus be used to secure and safely and efficiently position articles having either stemware or non-stemware configurations. This allows for the secure positioning and transport of articles such as wine glasses, martini glasses, champagne glasses all while utilizing a single portion of the device and a single tray.

FIG. 3 shows a bottom view of the serving tray 100 from FIG. 1 above. While FIG. 3 shows the most basic serving tray bottom 302, being plain, it is understood that the bottom 302 of the serving tray 100 can comprise various additional features to facilitate serving and/or to improve a server's grip and level of control of the serving tray. For example, the bottom 302 can comprise fingers holes as mentioned in regard to FIG. 2 above. The bottom surface can be treated to be more frictional and thus not slide, or minimally slide, in the palm of a server's hand. The bottom 302 can comprise handles or straps for better holding the serving tray 200 to a server's hand. The bottom 302 can also comprise features to enhance the sturdiness or structure of the serving tray 100, including enhancing the ability of the serving tray 100 to support weight (for example, in any form, shape, or configuration). Further examples of features that bottom 302 can comprise are set forth in regard to FIGS. 8-9 below.

FIGS. 4-7 depict various side views of the serving tray 100 of FIG. 1. These figures help illustrate a side view of the securing portions 104. FIGS. 4 and 6 also show a side view of the dedicated free portion 119. A tray may have one or more handles on its sides which can be permanently affixed, semi-permanently affixed, or temporarily fixed.

FIG. 8 shows a bottom plan view of a serving tray 300, similar to the serving tray 100 in FIG. 1 above, wherein like reference numbers are used to denote like features. The serving tray 300 comprises a body 102 and one or more securing portions 104. The bottom of serving tray 300 further comprises a handle portion 304. The handle portion 304 can comprise a wide variety of shapes and sizes, including the shape shown of a shaft portion 304 and a base portion 308. The user can grip the shaft portion 306 and rest his or her hand on the base portion 308, further easing transport of the serving tray 300.

The handle portion 304 can be made to be freely removable and re-attachable to the serving tray 300, allowing the handle portion 304 to function as a "stand" for the serving tray, for example, turning the moveable tray into a "platter" to be set on a table and back into a flat-bottomed serving tray as needed. The handle portion 304 can be attached to the bottom of the serving tray 300 by any permanent, semi-permanent or temporary means of attachment known in the art, for example, via adhesives, molding, welding and complementary structures (such as a screw and socket or a hook and loop structure such as Velcro®).

In some embodiments, the handle portion 304 can be configured with the serving tray 300 such that the serving tray can move, for example, freely rotate about the handle portion (for example the axis of the shaft portion 304) in a manner similar to that of a "lazy Susan." This allows for increased movability and access to various articles carried on the tray. The tray can be made rotatable in relation to the handle utilizing various connections known in the art that allow one structure to move or rotate about another structure, for example various joint connections such as pivot joints, ball and socket joints, condyloid (ellipsoid) joints, saddle joint and hinge joints. Alternatively or in addition, a flatter "lazy Susan" arrangement can be employed wherein a disk-like structure is connected to the bottom of the tray, allowing the tray to move in relation to the disk-like structure in the palm of a server's hand without the use of a handle.

FIG. 9 shows a bottom plan view of a serving tray 400, similar to the serving tray 100 in FIG. 1 above, wherein like reference numbers are used to denote like features. The serving tray 400 comprises a body 102 and one or more securing portions 104. The serving tray 400 further comprises an optional support structure 402 to provide additional structural integrity to the serving tray 400 and to help support the weight of articles carried by the tray. The use of the support structure 402 is particularly desirable in embodiments in which the body 102 is made of a more flexible or less sturdy material, as the support structure 402 can prevent or lessen the stress applied to the serving tray 400 and counteract bending or damage caused by uneven application of transported article weight. The support structure 402 can be any structure that can help preserve the structural integrity of the serving tray 400, for example, the series of support beams as shown in FIG. 9. The support structure can be added to the tray after manufacture or formed integrally to the tray during manufacture, for example, during molding or extrusion. These support structures 402 can also be configured to improve the grip of a server using the tray, for example, by allowing a server to grip the support structures to provide better handling of the tray.

Figure 10:
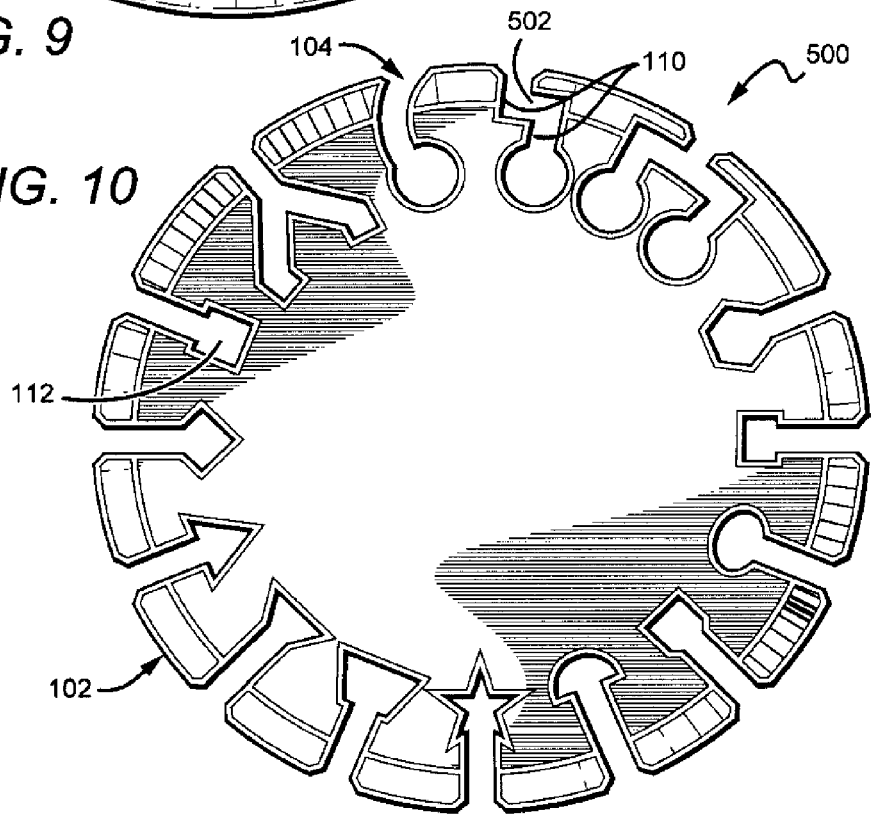
FIG. 10 is a top plan view of the serving tray according to an embodiment incorporating features of the present invention, demonstrating variations in securing portion design.

FIG. 10 shows a top plan view of a serving tray 500, similar to the serving tray 100 in FIG. 1 above, wherein like reference numbers are used to denote like features. The serving tray 500 comprises a body 102, one or more securing portions 104, which in turn comprise channels 110 and receptacles 112. FIG. 10 is primarily a means in which to demonstrate various example channel 110 and receptacle shapes 112. As mentioned above, channels and receptacles can comprise any number of shapes. Channels 110 can be elongated and can comprise features to assist in the securing of stemware, for example turns 502 within the channel to further direct stemware motion. Securing portions 104 can also comprise multiple receptacles or receptacles of various shapes as shown.

Figure 11:
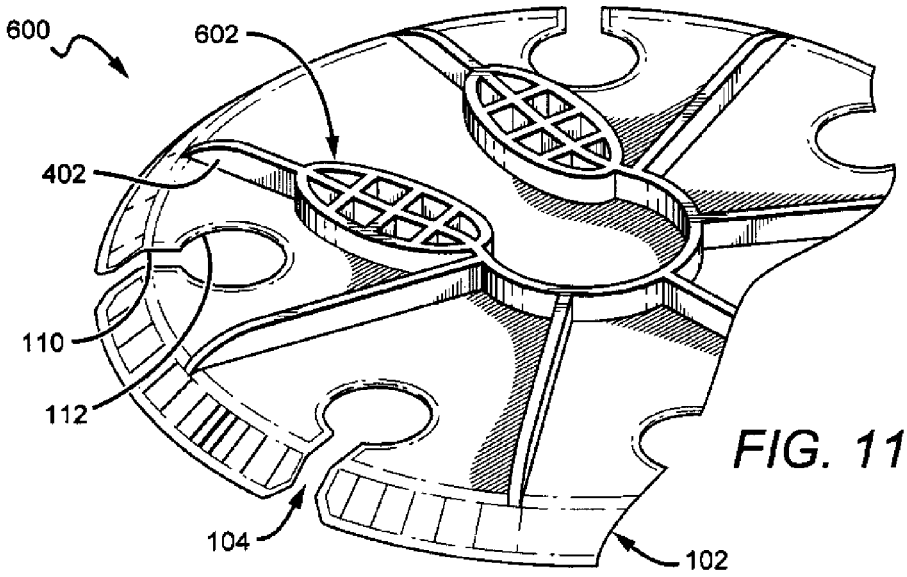
FIG. 11 is a side, back perspective view of a serving tray according to an embodiment incorporating features of the present invention.

FIG. 11 shows a bottom, side perspective view of a serving tray 600, similar to the serving tray 400 in FIG. 9 above, wherein like reference numbers are used to denote like features. The serving tray 600 comprises a body 102, one or more securing portions 104, which in turn comprise channels 110 and receptacles 112 and support structures 402. The serving tray 600 further comprises comfort structures 602, which can be part of support structures 402 or be a different part of body 102 or an additional structure connected to body 102 or a combination thereof. Comfort structures 602 can increase ease of use and relative user comfort by, for example, dispersing the weight of support structures 402 over a greater area so that the support structures aren't pressing into a server's arm or hand at a focused point or vertex with the increased weight of a loaded tray. In the embodiment shown, comfort structures 602 are a widened portion of the support structures 402 that are configured to disperse weight more evenly across a greater area. It is understood that other structures for assisting in user comfort are also within the scope of the present disclosure, for example, padded structures.

An additional advantage of serving trays incorporating features of the present invention include improved ergonomics. A user will not have to constantly adjust hand position when balancing multiple articles on the serving tray. Furthermore, multiple articles, such as drinks, can easily be carried by a user without worry of spillage or breaking a glass.

Figure 12:
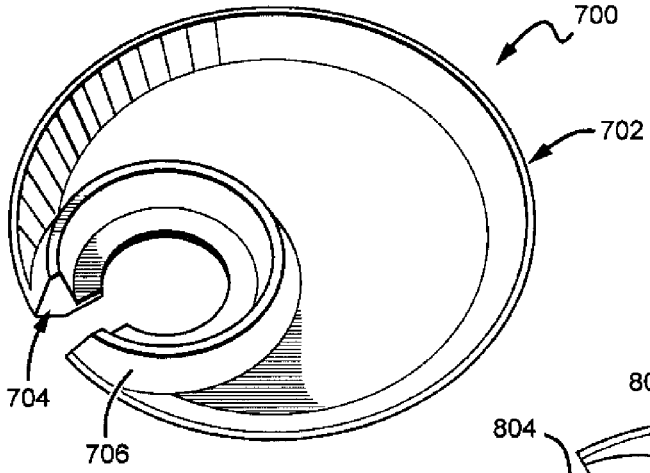
FIG. 12 is a top perspective view of a serving tray according to an embodiment incorporating features of the present invention.
Figure 13:
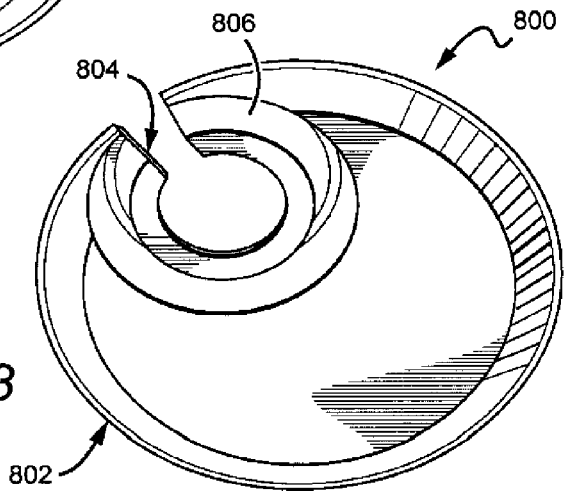
FIG. 13 is a bottom perspective view of a serving tray according to an embodiment incorporating features of the present invention.

FIGS. 12 and 13 show embodiments of the serving tray with a single drink holder portion. These trays are particularly useful for individual serving or self-service, for example, for an individual to utilize at a social event to free up on of his or her hands. FIG. 12 shows a top view of a tray 700, which comprises a body 702 and a securing portion 704 (comprising a raise border 706), which are similar to the body 102, securing portion 104, and raised border 210 in FIG. 2 above. Unlike the serving tray 200 in FIG. 2 above, the serving tray 700 of FIG. 12 only comprises a single securing portion 704. This allows an individual to utilizing the tray 700 as a individual device for holding a drink (either in a stemware or non-stemware container) in the securing portion 704 and holding food on an unoccupied portion of the tray.

FIG. 13 shows a bottom perspective view of a tray 800 comprising a body 802 and a securing portion 804, similar to the body 702 and the securing portion 704 in FIG. 12. However, instead of comprising a raised border like in FIG. 12, the tray 800 of FIG. 13 comprises a recessed portion 806. This recessed portion is similar to the recessed portions described above and allows for convenient holding of a non-stemware container. In some embodiments, the recessed portion can act as a stand or support for the tray when an individual sets it down. In embodiments having multiple securing portions comprising recessed portions, the recessed portions can be aligned and counterbalanced to further support the tray.

The top and/or bottom surfaces of serving trays incorporating features of the present invention can further include various features to promote marketing or otherwise personalize the trays. For example, the surfaces can include stickers, etchings, printings, embossments, resumes, advertisements, product or company names, logos, symbols, photos, drawings, pictures or other words and indicia.

Multiple portions of the serving tray can also utilize glow-in-the-dark portions as well as lighting, for example, light emitting diode (LED) lighting. This is useful for trays to improve visibility at night as to draw attention to the tray, for example, when such a tray is used in a nightclub and/or to highlight advertisements, logo, or indicia as well as to provide aesthetic/visual value to the tray.

It is understood that while the present disclosure mentions embodiments being substantially portable, such as trays, it is understood that devices incorporating features of the present invention can be incorporated into furniture, for example, having such a tray-like configuration replace or be connected to an armrest on a chair or sofa and/or a free standing table/end table. Devices incorporating features of the present invention can be connected to or incorporated into stands or other fixtures or objects either permanently, semi-permanently, or temporarily.

It is understood that devices incorporating features of the present invention can also be utilized with remotely or automatically mobile devices, such as an automated movement system, drone-device, robotics, etc., to allow the devices to be transported across a distance, for example, via automated control, programmed control and/or remote control.

Although the present invention has been described in detail with reference to certain preferred configurations thereof, other versions are possible. Embodiments of the present invention can comprise any combination of compatible features shown in the various figures, and these embodiments should not be limited to those expressly illustrated and discussed. Therefore, the spirit and scope of the invention should not be limited to the versions described above.

The foregoing is intended to cover all modifications and alternative constructions falling within the spirit and scope of the invention.

I claim:

1. A tray, comprising:

a body;

at least one securing portion within said body, said securing portion comprising a channel leading from an edge of said body to a receptacle area;

a raised border at least partially surrounding said at least one securing portion; and a raised lip at least partially around the perimeter of said body, wherein said raised border is spaced from said raised lip, wherein said body comprises substantially planar surfaces of substantially equal height on either side of said raised border.

2. The tray of claim 1, wherein said raised border completely surrounds said receptacle area.

3. The tray of claim 1, wherein said raised border completely surrounds said receptacle area and said channel except for the portion of said channel at said edge of said body.

4. The tray of claim 1, wherein said at least one securing portion comprises at least two securing portions.

5. A tray, comprising:

a body; and a plurality of securing portions within said body, each securing portion in said plurality configured to receive at least one stemware article, wherein each of said securing portions are at least partially surrounded by a separate raised border; and a raised lip at least partially around the perimeter of said body, wherein said body comprises substantially planar surfaces of substantially equal height on either side of at least one of said separate raised borders surrounding each of securing portions.

6. The tray of claim 5, wherein at least one of said securing portions within said plurality of securing portions is arranged such that the weight of stemware articles connected to said tray can be more evenly distributed.

7. A tray, comprising:

a body;

at least one securing portion within said body, said securing portion comprising a channel leading from an edge of said body to a receptacle area;

a raised border at least partially surrounding said at least one securing portion; and a raised lip at least partially around the perimeter of said body, said channel passing through said raised lip, wherein said body comprises substantially planar surfaces of substantially equal height on either side of said raised border.

8. The tray of claim 7, further comprising support structures configured to provide additional structural integrity to said tray.

* * * * *